United States Patent [19]

Coleman et al.

[11] 4,024,408

[45] May 17, 1977

[54] MINIMUM START TIMER FOR STARTING A DIESEL ENGINE

[75] Inventors: Donald F. Coleman, Dunlap; Richard H. Hoerr, Morton, both of Ill.

[73] Assignee: Caterpillar Tractor Co., Peoria, Ill.

[22] Filed: May 8, 1975

[21] Appl. No.: 575,850

[52] U.S. Cl. ..... 290/37 R; 290/38 R; 123/179 R

[51] Int. Cl.[2] ..... F02N 11/08

[58] Field of Search ..... 18/484, 434; 290/DIG. 1, DIG. 3, DIG. 10, DIG. 11, 37 R, 38 R, 38 C, 38 E, 37, 38; 307/133, 141; 123/179 R, 179 C, 179 D, 179 H; 340/52 R

[56] References Cited

UNITED STATES PATENTS

| | | | |
|---|---|---|---|
| 2,748,759 | 6/1956 | Schiffer | 290/38 C |
| 3,040,724 | 6/1962 | Kennemer | 290/37 R X |
| 3,862,429 | 1/1975 | Bucher | 290/38 X |

*Primary Examiner*—Robert J. Hickey
*Attorney, Agent, or Firm*—Wegner, Stellman, McCord, Wiles & Wood

[57] ABSTRACT

A start timer circuit for a diesel engine is responsive to the operator actuated start switch. The timer circuit energizes the engine start motor circuit for at least a minimum time, sufficient to avoid sustained firing of the engine at a low speed. Safety circuits prevent false energization of the start motor circuit in the event of malfunction or failure of various circuit components.

18 Claims, 1 Drawing Figure

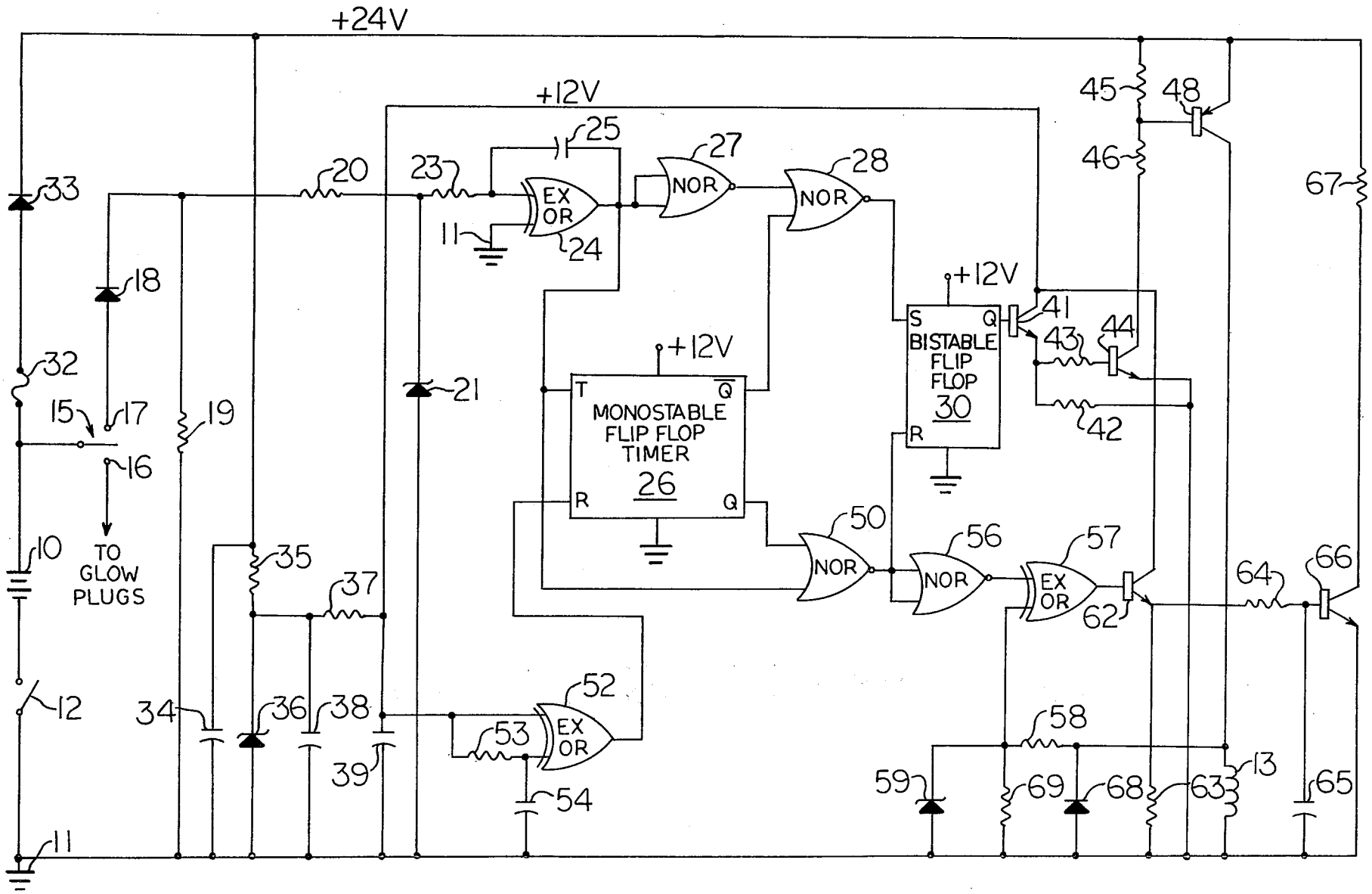
+24V
+12V
+12V
+12V
BISTABLE FLIP FLOP 30
MONOSTABLE FLIP FLOP TIMER 26
NOR
NOR
NOR
NOR
EX OR
EX OR
EX OR
TO GLOW PLUGS

MINIMUM START TIMER FOR STARTING A DIESEL ENGINE

BACKGROUND OF THE INVENTION

This application is concerned with a timer circuit for controlling the start motor of a diesel engine.

Diesel engines are generally provided with an electric start motor which cranks the engine at a speed of the order of 100 RPM. The drive train which connects the engine with a transmission or other load often has a torsional resonant speed or speeds and the drive train is designed to place these resonances below the idling speed of the engine. Typically, a resonant speed may occur between the cranking speed and the low idle speed (e.g., 600 RPM) as at about 200 RPM. When a cold engine is started, it is common to operate the start motor for a sufficient length of time to ensure acceleration past the low speed resonance. However, when a hot engine is restarted after a short shut-down, it will sometimes sustain fire at a speed as low as 100 RPM. The engine at this speed has very little torque, insufficient to accelerate through resonance. If the operator turns off the start motor at such a low speed, damage to the drive train may result. If, however, the start motor remains energized, the added torque it provides ensures that the engine will accelerate through the drive train resonance. We have found that with a typical diesel engine, the start motor should be operated for at least 0.8 second.

A principal feature of the invention is a diesel engine start motor control circuit which includes an operator actuated start switch, a timer initiated by actuation of the start switch and having an output with a minimum duration which is independent of the time for which the start switch is actuated, and a start motor circuit energized by the timer output.

Another feature is that the start motor circuit is energized in response to a combination of the timer output and actuation of the start switch so that the start motor circuit remains energized for the longer of the duration of the timer output and start switch actuation. More particularly, the timer has a monostable flip-flop circuit which is actuated by the start switch and has an output with a duration which is independent of the time for which the start switch is actuated. A bistable flip-flop latch circuit has an input responsive to a combination of the timer output and actuation of the start switch and has an output which controls energization of the start motor circuit. The bistable flip-flop latch circuit has a reset input which is responsive to the concurrent absence of actuation of the start switch and the timed output from the timer so that the bistable latch circuit is not reset until the timer is timed out and the operator has released the start switch.

A further feature of the invention is the provision of safety features in the start motor control circuit. One such safety circuit provides for resetting the monostable timer flip-flop when the vehicle disconnect switch is closed. Another compares the condition of the start motor circuit with the inputs from the start switch and timer. If they are not in agreement, the circuit is disabled by blowing a fuse.

Further features and advantages of the invention will readily be apparent from the following specification and from the drawing which is a schematic circuit diagram illustrating a preferred embodiment of the invention.

The start motor timer circuit is powered from a suitable voltage source as battery 10, one terminal of which is returned to a common connection or ground 11 through vehicle disconnect switch 12. The start motor circuit is represented by driver coil 13 which may, for example, actuate a relay to apply battery power to the electric start motor and engage the start motor drive pinion with the diesel engine (not shown).

Start switch 15 when closed with lower contact 16 energizes glow plugs to heat the engine for starting. When switch 15 is closed with its upper contact 17 the timed operation of the start motor circuit is initiated. Battery potential is applied through diode 18, which provides protection against reverse potentials, and across shunt load resistor 19 to the series combination of current limiting resistor 20 and the Zener diode voltage regulator 21. The voltage across the Zener diode is connected through the resistor 23 with one of the inputs of EX OR 24, the other input of which is returned to ground 11. In the absence of an input signal to EX OR 24, its output is a logic O. Capacitor 25 is connected between the output of EX OR 24 and the input to which the resistor 23 is connected. Resistor 23 and capacitor 25 provide a time delay so that the EX OR 24 does not have a logic 1 output immediately on closure of start switch 15. When switch 15 is opened, capacitor 25 discharges through resistors 23, 20 and 19 delaying the logic O output of EX OR 24. These time delays avoid false operation of the start motor circuit in the event of chatter of start switch 15.

The output of EX OR 24 is connected with the T input of monostable oscillator timer 26. When the EX OR output goes to 1, operation of the timer is initiated and the Q output goes to 1 and the Q output goes to O. These output conditions are maintained for the timing period, which may be of the order of one second.

The output of EX OR 24 is also connected with both inputs of NOR 27 which functions as an inverter. With a 1 applied to the inputs, the output is 0. The output of inverter NOR 27 and the Q output of timer 26 are connected as inputs to NOR 28, the output of which is connected with the S or set input of bistable flip-flop latch circuit 30. When NOR 28 has two 0 inputs, it has a 1 output, causing flip-flop 30 to assume the set condition with a 1 signal at the Q output.

The remainder of the circuit for energizing the start motor relay or driver coil 13 utilizes transistors powered directly or indirectly from battery 10. In a typical circuit the battery has a voltage of 24 volts. It is connected through fuse 32 and isolating diode 33 with a shunt filter capacitor 34. A low voltage power supply provides a reduced voltage, as 12 volts, for some of the transistors. Current limiting resistor 35 and Zener diode 36 establish the reduced voltage which is filtered by series resistor 37 and shunt capacitors 38, 39.

Emitter-follower transistor 41 has its base connected with the Q output of bistable latching flip-flop 30 and its collector-emitter circuit connected through load resistor 42 across the low voltage power supply. The output of the emitter follower transistor is connected through isolating and current limiting resistor 43 with the base of driver transistor 44 which has an emitter-collector circuit connected through collector load resistors 45, 46 across battery 10. Switching transistor 48 for start motor circuit coil 13 has its base connected with the junction of resistor 45, 46, its emitter connected with the battery 10 and its collector connected through coil 13 with ground 11.

A 1 signal from the Q output of bistable flip-flop 30 turns on emitter-follower transistor 41, driver transistor 44 and switching transistor 48, energizing the start motor. So long as the Q output of bistable latching flip-flop 30 remains at 1, the start motor circuit is energized.

After the timer 26 completes its timing period, which may be set by the selection of suitable resistor and capacitor components (not shown), its outputs reverse, Q going to 1 and Q to 0, regardless of whether start switch 15 is closed or is opened. The output of NOR 28 goes to 0. This, however, does not affect latching flip-flop 30, which cannot change its condition until a 1 signal is applied to the reset input R.

The Q output of timer 26, which provides one of the inputs from NOR 50, goes to 0. The other input for NOR 50 is obtained from the output of EX OR 24. If start switch 15 remains closed, this signal is a 1 and latching flip-flop 30 remains set. If, however, the operator has opened start switch 15, the output of EX OR 24 is 0. With two 0 inputs, NOR 50 has a 1 output, resetting flip-flop 30 and terminating energization of the start motor circuit. Thus, so long as either bistable flip-flop timer 26 has not completed its timing period or start switch 15 remains closed, the start motor circuit is energized. Conversely, when timer 26 has completed its timing period and start switch 15 is open, the start motor circuit is deenergized.

In a typical diesel engine start system, the period for timer 26 may be of the order of $1.0 \pm 0.2$ seconds. It has been found that this is sufficient time for a hot engine to start and accelerate through the low speed resonance of the drive train.

The control circuit includes several safety features. When vehicle disconnect switch 12 is closed and prior to operation of start switch 15, bistable flip-flop timer 26 is reset. This is accomplished by the circuit of EX OR 52. One input is connected directly across filter capacitor 39 and thus goes to a 1 condition as soon as vehicle disconnect switch 12 is closed. The other input of EX OR 52 is connected across capacitor 39 through a time delay circuit including series resistor 53 and shunt capacitor 54. So long as the signal at the other input remains at 0, EX OR 52 has a 1 output. The time period for the circuit is such that EX OR 52 has a 1 output for about 0.1 second, ensuring reset of the timer 26 so that the timer is ready for actuation when start switch 15 is closed.

If there is a failure in the timer, and no timing pulse is produced, the start cycle is not initiated. If, on the other hand, there is a failure in the NOR 28, flip-flop 30 or the switching circuit of transistors 41, 44 and 48, the control circuit is rendered inoperative.

A monitor circuit compares the condition of the actuating signals for the start motor circuit with the condition of the start motor circuit. If the signal and circuit conditions do not agree, fuse 32 is blown to prevent damage to the start motor or the control circuit. The inputs of NOR 50 represent the condition of start switch 15 and the output of timer 26, the two signals which are required to set bistable latching flip-flop 30 and energize the start motor circuit. The output of NOR 50 is connected with both inputs of NOR 56, which serves as an inverter, the output of which is connected as one of the inputs of EX OR 57. The other input of EX OR 57 is derived from the voltage across start motor circuit driver coil 13. The coil voltage is connected through current limiting resistor 58 with Zener diode 59, and the diode voltage provides a logic 1 input signal to EX OR 57. When both start enabling signals are present, the output of NOR 50 is 0 and the output of inverter 56 is a logic 1. Conversely, if both signals are not present at the input of NOR 50, its output is a logic 1 and the output of inverter 56 is 0. EX OR 57 serves to compare the start circuit input signals with the condition of the start motor circuit. So long as the two inputs EX OR 57 are the same, the output is 0. If, however, the inputs differ, the output is a logic 1. If this difference should occur, driver transistor 62 is connected with the low voltage supply and the emitter is returned through load resistor 63 to ground 11. The voltage across load resistor 63 is connected through a time delay circuit, series resistor 64 and shunt capacitor 65, with the base of fail safe transistor switch 66 which has an emitter-collector circuit connected through current limiting resistor 67, in series with diode 33 and fuse 32 across battery 10. Conduction of transistor 66 causes fuse 32 to blow, disabling the circuit and preventing damage. The time delay afforded by resistor 64 and capacitor 65 prevents blowing fuse 32 if the input signals of EX OR 57 do not occur at precisely the same instant.

Diode 68 discharges the inductive field of coil 13 when the start circuit is deenergized, preventing possible damage to other circuit components.

If coil 13 is disconnected from the circuit, as for servicing or the like, and vehicle enable switch 12 is closed, leakage current through transistor 48 will build up a voltage on the lower input of EX OR 57 which could cause conduction of transistor 66 and blow fuse 32. Resistor 69 connected in shunt with Zener diode 59 provides a return path for this leakage current.

What is claimed is:

1. A control circuit for the start motor of a diesel engine, comprising: an operator actuated start switch; a timer initiated by actuation of said start switch and having an output with a minimum duration independent of the time for which the start switch is actuated; and a start motor circuit energized by the output of said timer; and a circuit for providing a time delay between the operator actuated start switch and the timer, to avoid false operation of the start motor circuit in the event of chatter of the start switch.

2. A control circuit for the start motor of a diesel engine, comprising: an operator actuated start switch; a timer initiated by actuation of said start switch and having an output with a minimum duration independent of the time for which the start switch is actuated; and a start motor circuit energized by the output of said timer, wherein the start motor circuit is energized in response to a combination of the timer output and actuation of the start switch, energization of the start motor circuit being for the longer of the duration of the timer output and the start switch actuation.

3. The start motor control circuit of claim 2 in which the timer includes a monostable flip-flop actuated by said start switch and having an output with a duration independent of the time for which the start switch is actuated, the start motor circuit being energized by the output of the monostable flip-flop.

4. The start motor control circuit of claim 2 including a circuit providing time delay between the operator actuated start switch and the timer, to avoid false operation of the start motor circuit in the event of chatter of the start switch.

5. The start motor control circuit of claim 2 including a bistable flip-flop latch circuit having an input responsive to a combination of said timer output and actuation of the start switch, said bistable flip-flop having an output which effects energization of said start motor circuit.

6. The start motor control circuit of claim 5 in which said bistable flip-flop has a SET input, the control circuit including a circuit responsive to the occurrence at the same time of actuation of the start switch and an output from said timer to energize the start motor circuit.

7. The start motor control circuit of claim 6 in which said bistable flip-flop has a RESET input, the control circuit including a circuit responsive to the concurrent absence of actuation of the start switch and a timed output from aid timer, having an output connected with the RESET input of the bistable flip-flop to reset the flip-flop and terminate energization of the start motor circuit.

8. The start motor control circuit of claim 3 including a power source for the flip-flop, a vehicle disconnect switch in the circuit between the power source and the monostable flip-flop, closed by the operator to connect the power source with the circuit, said monostable flip-flop having a RESET input, and means operative on closure of the vehicle disconnect switch to generate a signal connected with the RESET input of the monostable flip-flop.

9. The start motor control circuit of claim 8 in which said last identified circuit is a two-input EX OR circuit having one input connected to the power source through the vehicle disconnect switch and with a time delay circuit connected between the power source and the other input, the output of said EX OR circuit being connected with the RESET input of the monostable flip-flop and occurring from closure of the vehicle disconnect switch until the end of the prior of the time delay circuit.

10. A fail safe control circuit for the start motor of a diesel engine, comprising: an operator actuated start switch; a start motor circuit; means responsive to actuation of said start switch by the operator to energize said start motor circuit; and a monitor circuit for comparing the condition of the start switch responsive means with the condition of the start motor circuit and for disabling the start motor circuit if they are not in the same condition.

11. The fail safe start motor control circuit of claim 10 including a time delay circuit between the monitor circuit and the means for disabling the control circuit if the start switch and control circuit conditions are not the same.

12. The fail safe start motor control circuit of claim 10 including a power source for the start motor circuit, a fuse in series with the power source and a high current load for said power source, said load being actuated in the event the start switch and control circuit are not in the same condition to blow the fuse and disable the start motor control circuit.

13. A fail safe control circuit for the start motor of a diesel engine, comprising: an operator actuated start switch; a start motor circuit; a monostable flip-flop timer actuated by said start switch and having an output with a duration independent of the time for which the start switch is actuated; means responsive to actuation of said start switch by the operator and to the timer output to energize said start motor circuit; and a monitor circuit for comparing the conditions of the start switch and the timer output with the condition of the start motor circuit and for disabling the start motor circuit if they are not in the same condition.

14. The fail safe start motor control circuit of claim 13 including a NOR circuit having inputs connected with the start switch and the timer output, said monitor circuit comparing the output of the NOR circuit with the condition of the start motor circuit.

15. A control circuit for the start motor of a diesel engine, comprising: an operator actuated start switch; a monostable flip-flop timer initiated by actuation of said start switch and having an output with a duration independent of the time for which the start switch is actuated; a bistable flip-flop latch circuit having an input responsive to a combination of said timer output and actuation of the start switch; and a start motor circuit energized by the output of said latch circuit.

16. The start motor control circuit of claim 15 in which said bistable flip-flop has a SET input, the control circuit including a circuit responsive to the occurrence at the same time of actuation of the start switch and an output from said timer, connected with said SET input.

17. The start motor control circuit of claim 15 including a monitor circuit for comparing the condition of the start switch with the condition of the start motor circuit and for disabling the start motor circuit if they are not in the same condition.

18. The start motor control circuit of claim 15 including a power source for the monostable flip-flop, a vehicle disconnect switch in the circuit between the power source and the monostable flip-flop, closed by the operator to connect the power source with the circuit, said monostable flip-flop having a RESET input, and means operative on closure of the vehicle disconnect switch to generate a signal connected with the RESET input of the monostable flip-flop.

* * * * *

UNITED STATES PATENT AND TRADEMARK OFFICE

CERTIFICATE OF CORRECTION

PATENT NO. : 4,024,408

DATED : May 17, 1977

INVENTOR(S) : Donald F. Coleman and Richard H. Hoerr

It is certified that error appears in the above-identified patent and that said Letters Patent are hereby corrected as shown below:

Column 2, line 34, change "Q" (second occurrence) to -- $\overline{Q}$ --;

Column 2, line 40, change "Q" to -- $\overline{Q}$ --;

Column 3, line 10, change "Q" (first occurrence) to -- $\overline{Q}$ --.

Column 5, line 39, change "prior" to -- period --.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*